US005924812A

United States Patent [19]

Goldman

[11] Patent Number: 5,924,812

[45] Date of Patent: Jul. 20, 1999

[54] PRINTABLE INDEX SHEET

[75] Inventor: Michael Goldman, Deerfield, Ill.

[73] Assignee: ACCO Brands, Inc., Lincolnshire, Ill.

[21] Appl. No.: 08/820,059

[22] Filed: Mar. 18, 1997

Related U.S. Application Data

[63] Continuation-in-part of application No. 08/700,890, Aug. 21, 1996.

[51] Int. Cl.[6] ..... B42F 13/00

[52] U.S. Cl. ..... 402/79; 281/38; 281/2

[58] Field of Search ..... 281/2, 5, 38; 402/79, 402/80 R; 283/81, 36; 40/641; 428/40

[56] References Cited

U.S. PATENT DOCUMENTS

| | | | |
|---|---|---|---|
| 5,144 | 11/1847 | Partridge . | |
| 529,477 | 11/1894 | Brown . | |
| 561,888 | 6/1896 | Hon . | |
| 612,078 | 10/1898 | Wickham | 281/38 |
| 764,701 | 7/1904 | Ayres | 281/38 |
| 783,365 | 2/1905 | Coleman . | |
| 843,416 | 2/1907 | Ohashi . | |
| 1,048,577 | 12/1912 | Pardoe, Jr. . | |
| 1,058,118 | 4/1913 | Wardy . | |
| 1,142,644 | 6/1915 | Vesterling . | |
| 1,151,475 | 8/1915 | Kingsley et al. . | |
| 1,428,102 | 9/1922 | Kelly . | |
| 1,429,436 | 9/1922 | Kelly . | |
| 1,501,234 | 7/1924 | Rand . | |
| 1,559,129 | 10/1925 | Pimm . | |
| 1,777,499 | 10/1930 | Kupfer . | |
| 1,861,259 | 5/1932 | Brasseur . | |
| 1,922,213 | 8/1933 | Middleton . | |
| 1,924,755 | 8/1933 | Rubin . | |
| 2,001,651 | 5/1935 | Bingham . | |
| 2,300,623 | 11/1942 | Hornung . | |
| 2,345,793 | 4/1944 | Chapel . | |
| 2,502,785 | 4/1950 | Gottschalk . | |
| 2,576,272 | 11/1951 | Adelman . | |
| 3,454,451 | 7/1969 | Buckholz . | |
| 3,770,943 | 11/1973 | Sill . | |
| 3,970,397 | 7/1976 | Armstrong . | |
| 4,043,573 | 8/1977 | Griffin . | |
| 4,046,615 | 9/1977 | Jansen . | |
| 4,127,690 | 11/1978 | Schleifenbaum et al. . | |
| 4,184,699 | 1/1980 | Lowe | 281/41 |
| 4,240,848 | 12/1980 | Barber . | |
| 4,422,672 | 12/1983 | Levi | 283/39 |
| 4,430,015 | 2/1984 | Nerlinger | 402/79 |
| 4,431,325 | 2/1984 | Colby | 402/79 |
| 4,446,183 | 5/1984 | Savagian . | |
| 4,447,481 | 5/1984 | Holmberg et al. | 428/40 |
| 4,448,558 | 5/1984 | Weingarten . | |
| 4,479,733 | 10/1984 | Segal | 402/79 |
| 4,523,775 | 6/1985 | Reist . | |
| 4,529,227 | 7/1985 | Fields . | |
| 4,560,600 | 12/1985 | Yellin et al. | 428/43 |
| 4,568,108 | 2/1986 | Simpson | 281/2 X |

(List continued on next page.)

FOREIGN PATENT DOCUMENTS

| | | |
|---|---|---|
| 92696 | 4/1990 | Japan . |
| 219435 | 3/1968 | Sweden . |
| 23716 | 10/1897 | United Kingdom . |
| WO 93/04943 | 3/1993 | WIPO . |

OTHER PUBLICATIONS

ACCO USA, Inc., Wheeling, Illinois, *Multidex Index Product Brochure—Quick Reference Index System*, ©1992.

Duralon Product Brochure—excerpt.

JBC Design Group, Inc., Torrance, California, *Extend-A-Tab*™ Product Brochure—Dual-Insertable Tabs, ©1995.

*Primary Examiner*—Willmon Fridie, Jr.

*Attorney, Agent, or Firm*—Pennie & Edmonds LLP

[57] ABSTRACT

An index sheet which may be accommodated by and directly printed upon by a conventional printer. The index sheet includes a body section, a foldable bindable section extending along one edge of the body section and a guide overlappingly and removably attached along the opposite edge of the body section. The index sheet is made of a paper-plastic laminate.

5 Claims, 1 Drawing Sheet

U.S. PATENT DOCUMENTS 4,636,179 1/1987 Gentile et al. ..... 402/79
4,643,452 2/1987 Chang .
4,643,455 2/1987 North et al. ..... 283/81
4,662,770 5/1987 Block ..... 402/80 R
4,704,317 11/1987 Hickenbotham et al. .
4,748,758 6/1988 Gaston .
4,773,676 9/1988 Showering ..... 281/2
4,779,897 10/1988 Schall et al. ..... 281/38
4,784,508 11/1988 Shannon ..... 402/79
4,802,692 2/1989 Stryd ..... 281/5
4,803,795 2/1989 Questel et al. ..... 402/79 X
4,810,544 3/1989 Hickman .
4,822,017 4/1989 Griesmyer .
4,844,508 7/1989 Choi .
4,865,477 9/1989 George .
4,884,826 12/1989 Slagsvol ..... 281/2
4,884,827 12/1989 Kelley .
4,887,925 12/1989 Groswith, III et al. ..... 402/15
4,910,066 3/1990 Foisie ..... 428/137
4,911,777 3/1990 Truc et al. ..... 156/252
4,923,111 5/1990 Down .
4,952,091 8/1990 Sirko ..... 402/79
4,952,433 8/1990 Tezuka et al. .
4,961,666 10/1990 Pitts et al. ..... 402/79
4,962,603 10/1990 Kao et al. .
4,972,952 11/1990 Reisender .
4,990,018 2/1991 Best et al. ..... 402/79
5,016,370 5/1991 Rhian et al. ..... 283/36 X
5,033,899 7/1991 Pitts et al. .
5,040,216 8/1991 Policht .
5,044,807 9/1991 Meservy et al. .
5,076,490 12/1991 Dulin ..... 402/79 X
5,125,561 6/1992 Idstein .
5,135,261 8/1992 Cusack et al. ..... 283/81
5,174,606 12/1992 Hure .
5,180,461 1/1993 Widmann ..... 156/216
5,187,888 2/1993 O'Brien et al. .
5,219,183 6/1993 McKillip .
5,228,388 7/1993 Brown .
5,299,879 4/1994 Burrow ..... 402/79
5,316,344 5/1994 Popat et al. .
5,333,908 8/1994 Dorney .
5,340,427 8/1994 Cusack et al. ..... 156/268
5,389,414 2/1995 Popat ..... 428/40
5,401,058 3/1995 Holmberg ..... 281/2 X
5,407,234 4/1995 Rettker et al. .
5,407,718 4/1995 Popat et al. .
5,468,085 11/1995 Kline .
5,477,336 12/1995 Deighton .
5,503,435 4/1996 Kline .
5,524,998 6/1996 Schwartz .
5,558,454 9/1996 Owen ..... 402/79
5,571,587 11/1996 Bishop et al. .
5,599,128 2/1997 Steiner .
5,601,313 2/1997 Konkol et al. ..... 281/2 X
5,662,976 9/1997 Popat et al. .
5,743,566 4/1998 Hunter et al. .
5,782,494 7/1998 Crandall et al. ..... 281/2
5,792,297 8/1998 Hunter et al. .

PRINTABLE INDEX SHEET

RELATED APPLICATIONS

This application is continuation-in-part to application Ser. No. 08/700,890, filed Aug. 21, 1996.

FIELD OF THE INVENTION

The present invention relates generally to index sheets and, more particularly, to bindable index sheets which can be directly printed on by machines, such as computer operated printers.

BACKGROUND ART OF THE INVENTION

Index tabs for quick identification and selection of information from looseleaf or hardbound binders are a common feature of nearly every well-organized office or home. Typically, these index tabs are provided as markings on certain sheets or pages of binders, books, notebooks, or other multiple sheet material. In order to facilitate ease of scanning and selecting pages, the index tabs are typically. staggered or spaced, along two orthogonal planes. For example, the index tabs connected to the edge of adjacent index sheets are positioned just far enough away from each other so that the identifying text or characters or symbols appearing on both index tabs can be seen simultaneously. Uses for such index tabs range from simple referencing to presentations.

In general, index tabs are made in one of two ways. The tabs may be integrally formed as protrusions of the index sheets themselves as shown, for example, in U.S. Pat. Nos. 4,184,699 issued to Lowe on Jan. 22, 1980 and 5,558,454 issued to Owen on Sep. 24, 1996. Alternatively, the tabs may be separate components which are connected to the index sheets as shown, for example in U.S. Pat. No. 4,962,603 issued to Kao et al. on Oct. 16, 1990; U.S. Pat. No. 5,135,261 issued to Cusack et al. on Aug. 4, 1992; U.S. Pat. No. 5,340,427 issued to Cusack et al. on Aug. 23, 1994; and U.S. Pat. No. 5,389,414 issued to Popat on Feb. 14, 1995.

As the Kao et al. patent indicates, forming index tabs as integral protrusions of the index sheet has been disadvantageous, since it has been difficult to machine print identifying text on the index tabs. For example, it has been impractical to insert the entire index sheet into a standard typewriter in order to type text sideways onto the protruding index tab. It has also been difficult or impossible to feed index sheets directly through common office printers, such as laser printers, inkjet printers or office copiers, without encountering jamming problems, limited feed size problems, or distorted printing problems. The patent to Owen recognized these problems and proposed a solution of a foldable binding edge and removable portion along the tab edge.

It is desirable to print index sheets on laser or inkjet printers due to the great flexibility of what can be printed as well as the high print quality provided by such printers or the like. However, such printers require the sheet stock to be uniformly dimensioned, at least widthwise, according to standard sizes in order to be accommodated by the standard sized feeding tray and pathway of such printers. Otherwise, the sheet stock will either tend to jam within such printers or not even fit into such printers. Index sheets, having protruding tabs on the top or leading edge first drawn into the printer, can also jam or stray from the correct feed path. Moreover, the sheet stock must be strong enough to withstand the stresses imposed on the sheets by the feeding mechanisms and pressure rollers, and must provide a uniformly smooth surface that will properly take up the toner. Because of these requirements, conventional index sheets having nonuniform widths due to protruding index tabs have been poorly suited for use in laser or inkjet printers.

This drawback is all the more pronounced when the tabs are to be used to mark the pages of a hardbound or softbound book. As a result, the identifying text is usually either handwritten onto the tabs, or else the text is printed on separate adhesive labels which are then placed on the corresponding tabs.

The present invention is directed to overcoming the problems as set forth above.

SUMMARY OF THE INVENTION

In the present invention, a directly-machine-printable index sheet is disclosed. The index sheet comprises a main body section having first and second edges, and a bindable section formed integrally with and extending outwardly from the first edge. The bindable section includes the usual binder holes for securing the index sheet into a ringed binder. The construction of the bindable section permits not only easy folding; but in the folded position, the bindable section will lay flat without requiring an adhesive. This facilitates movement of the index sheet through a printing machine.

An index tab extends outwardly from the second edge of the index sheet and a guide section is removably attached to this edge. The guide section, which is self-sticking, has an outer guide edge extending outwardly beyond the edge of the main body section generally in the same direction as the index tab. The guide functions on the tabbed edge of the main body section to provide a straight edge for feeding of the index sheet through a printer. The self-sticking nature of the guide facilitates attachment and easy removal.

The index sheet of the present invention has a transformable configuration allowing it to pass, in a guided or controlled fashion, through a printing machine such as a computer-operated printer or copier. After the index sheet is directly printed upon by the machine, the index sheet can be transformed, either manually or by machine, so that its index tab stands out for identifying, separating, or otherwise distinguishing documents or other items with which one or more index sheets are kept.

DETAILED DESCRIPTION OF THE INVENTION

Figure 1:
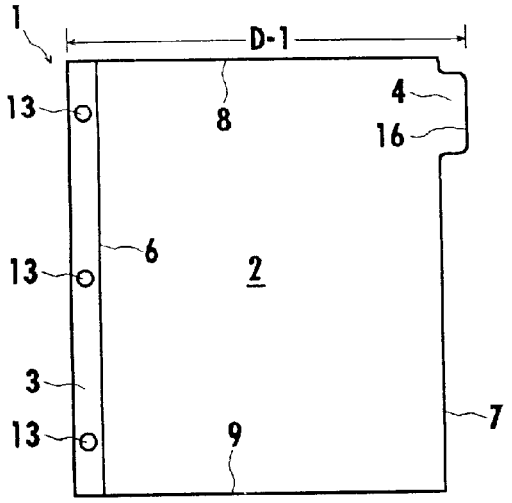
FIG. 1 is a top plan view of an exemplary embodiment of an index sheet of the present invention, including a bindable section unfolded and with no guide.

The index sheet 1 comprises a generally rectangular main body section 2, a bindable section 3, at least one index tab 4, and a guide 5.

Figure 5:
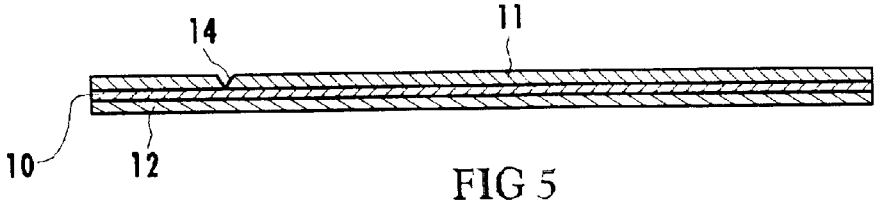
FIG. 5 is a greatly enlarged cross-sectional view of the index sheet, taken along line 5—5 of FIG. 1.
Figure 6:
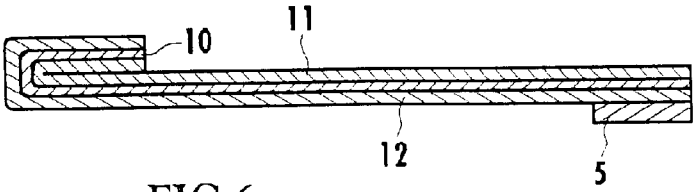
FIG. 6 is a greatly enlarged cross-sectional view, taken along line 6—6 of FIG. 2.

The main body section 2 includes opposed spaced-apart first (lefthand binding) and second (righthand index) edges 6, 7 and opposed spaced-apart third (top) and fourth (bottom) edges 8, 9. Each of the third and fourth edges 8, 9 intersect and are generally perpendicular to each of the first and second edges 6, 7. The index sheet 1 is formed of a composite material of paper/plastic laminate. The presently preferred material is a paper/plastic laminate product known as Duralon™, which is made by Arlon, Adhesives and Film Division, Santa Ana, Calif. As shown in FIGS. 5 and 6, the laminate has a central tear-resistant plastic polyester film 10 bonded between two layers 11, 12 of premier paper stock. The overall thickness of the index sheet is about 5½ mils, with the central plastic film being 1½ mils thick and each of the outer paper layers being about 2 mils thick. Index sheets of this construction can be used with laser and dot matrix printers, as well as office copiers.

The bindable section 3 extends outwardly from the first edge 6 of the main body section 2 and includes the usual binder holes 13, spaced from the main body section 2. The edge 6 between the main body section 2 and the bindable section 3 is defined by a V-shaped groove 14 pressed into the upper paper layer 11. In the preferred embodiment, the groove 14 terminates at the interface between the upper layer 11 and the central film 10. The groove is formed in the index sheet by feeding the sheet through a pair of suitably shaped rollers.

The overall width of the index sheet is shown in FIG. 1 at D-1. This width is too large to fit through the normal feed path of a typical copier or printer. For example, for indexing standard 8½"×11" length items, D-1 will be about 9". In order to reduce the width of this index sheet for feeding through the printer or copier, the binding section is folded over along the groove 14. In the folded position of the bindable section, the overall width D-2 of the index sheet is about 8⅜", which is a suitable width for feeding through the normal printer or copier. In the folded over position of the bindable section, the index sheet is fed through rollers to press the folded section against the body section and provide an overlap zone in which the bindable section lies flat against the body section without the use of adhesives. The total thickness in this overlap zone is about 11 mils, twice the thickness of the exposed body section. This flat condition is necessary in order for the folded sheet to be fed through the printer or copier.

For further facilitating the feeding of the index sheet through the printer or copier, the guide 5 is provided along the righthand index edge 7. In the preferred embodiment, this guide is a self-sticking separate component removably overlappingly connected to the main body section 2. The guide 5 has an outer (righthand) guide edge 15 extending outwardly beyond the edge 7 of the main body 2 in the same direction as the index tab 4. In the embodiment shown in FIG. 2, the guide 5 overlaps both the main body 2 and the index tab 4 with the guide edge 15 aligned with the outer edge 16 of the tab. The edge 15 of the guide 5 is positioned at a substantially uniform distance from the folding groove 14 or the lefthand edge 20 of the body section. The guide 5 extends along substantially the entire length of the index sheet. Although the edge 15 of the guide 5 is shown as aligned with the outer edge 16 of the tab, the guide may be positioned on the index sheet so that the edge 15 lies slightly outwardly of the outer edge 16 of the tab.

Figure 3:
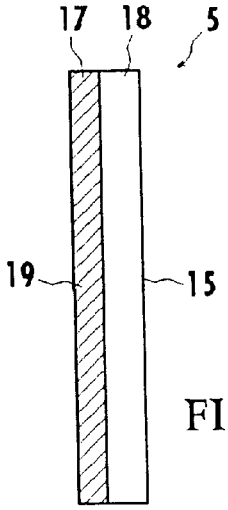
FIG. 3 is an isolated view of the guide shown in FIG. 2.
Figure 4:
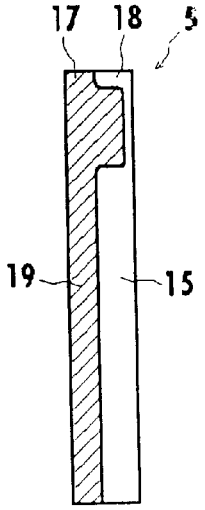
FIG. 4 is a view similar to FIG. 2 but showing an alternative embodiment of the guide.

FIG. 3 shows one embodiment of the guide 5 as including a first portion 17 and a second portion 18. The first portion is coated with a low-tac self-sticking adhesive 19 for removably attaching the guide to the body section 2 of the index sheet. FIG. 4 shows an alternative embodiment of the guide 5 in which the adhesive 19 is applied in a pattern which will cover the index tab 4 when attached to the index sheet. The connection of the guide 5 to the index tab 4 advantageously provides additional strength and stabilization of the guide when the index sheet is passing through the printing or copying machine.

In the presently preferred construction of the invention, the guide has a thickness of between about 2½ and 3½ mils. Accordingly, when attached to the body section of the index sheet the total thickness of the overlap zone of the index sheet and guide, as shown in FIG. 6, will be between about 8 and 9 mm.

Figure 2:
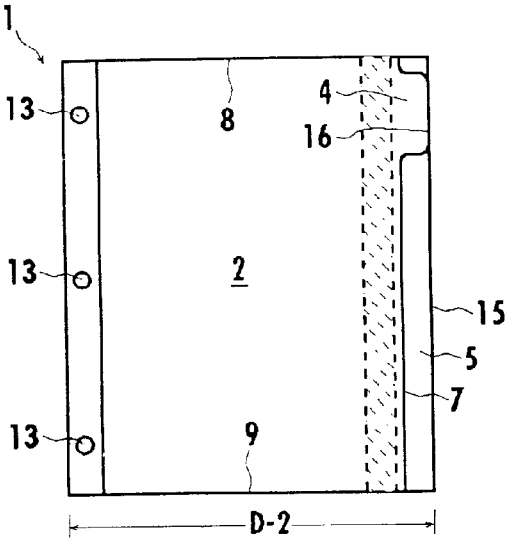
FIG. 2 is a view similar to FIG. 1 but after the bindable section has been folded and the guide has been attached.

With the above construction of the index sheet and with the bindable section 3 folded and the guide 5 attached, as shown in FIG. 2, the sheet presents itself to the printer or copier in the same manner as a normal rectangular sheet of paper. The guide 5 provides the straight guide edge 15 so as to prevent skewing of the index sheet as it is being fed. In addition, the added thickness of the guide in the overlap zone extending along the index edge of the index sheet compensates for the added thickness in the overlap zone extending along the binding edge of the guide sheet as caused by the folded over bindable section. In the construction described above, the total thickness along the binding edge of the sheet is about 11 mils whereas the thickness along the index edge is between about 8 and 9 mils. This difference in thickness is easily handled by the feeding mechanism of the normal printer or copier. To further equalize the thicknesses, the thicknesses of the index sheet and the guide can be coordinated, as for example, the guide can be constructed of a thickness of 5½ mils, so that when applied the total thicknesses along both overlap zones extending along the binding edge and index edge of the sheet will be the same.

I claim:

1. An index sheet for separating a plurality of text sheets having a predetermined width no greater than the maximum feed width of a printing machine, comprising:

a) a main body section having a predetermined thickness and opposed first and second edges;

b) a bindable section integral with said main body section and extending outwardly from said first edge of said main body section, said bindable section being foldable over said first edge and into overlapping relation with said main body section to define a first overlap zone of a first thickness greater than said predetermined thickness;

c) an index tab extending outwardly by a predetermined distance from said second edge of the main body section;

d) a self-sticking guide removably overlappingly connected to the main body section adjacent said second edge to define a second overlap zone of a second thickness greater than said predetermined thickness, said guide having a guide edge disposed outwardly by at least said predetermined distance from said second edge of the main body section and extending parallel to said first edge;

e) said main body section together with said guide having a width, as measured between said first edge and said guide edge, no greater than said maximum feed width of said printing machine; and f) said index sheet is constructed of a paper-plastic laminate having a central plastic layer and an upper and lower paper layer on either side of said plastic layer.

2. The index sheet according to claim 1, wherein:

a) said bindable section is folded over onto one of said upper and lower paper layers; and b) said guide is removably connected to the other of said upper and lower paper layers.

3. The index sheet according to claim 1, wherein:

a) one of said paper layers is grooved along said first edge, said groove terminating at the interface between the one paper layer and the plastic layer; and b) said bindable section is folded along said groove and onto said one paper layer.

4. The index sheet according to claim 3, wherein:

a) said first and second thickness of said first and second overlap zones are about equal to each other.

5. The index sheet according to claim 3, wherein:

a) said plastic layer is about 1.5 mils in thickness;

b) each of said paper layers is about 2 mils in thickness; and c) said guide is between about 2.5 and 3.5 mils in thickness.

* * * * *